US012502009B2

(12) United States Patent
Lim

(10) Patent No.: US 12,502,009 B2
(45) Date of Patent: Dec. 23, 2025

(54) SIDE HIP SEAT BABY CARRIER

(71) Applicant: Konny By Erin Inc., Seoul (KR)

(72) Inventor: E Rang Lim, Seoul (KR)

(73) Assignee: Konny By Erin Inc., Seoul (KR)

( * ) Notice: Subject to any disclaimer, the term of this patent is extended or adjusted under 35 U.S.C. 154(b) by 0 days.

(21) Appl. No.: 18/953,320

(22) Filed: Nov. 20, 2024

(65) Prior Publication Data

US 2025/0089911 A1 Mar. 20, 2025

Related U.S. Application Data

(63) Continuation of application No. PCT/KR2023/014985, filed on Sep. 27, 2023.

(30) Foreign Application Priority Data

Sep. 18, 2023 (KR) ..... 10-2023-0124165

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025; A47D 13/029
USPC ..... 224/158–160
See application file for complete search history.

(56) References Cited

U.S. PATENT DOCUMENTS

| | | | | |
|---|---|---|---|---|
| 1,109,065 | A * | 9/1914 | Heath et al. | A47D 13/025 224/159 |
| 1,162,662 | A * | 11/1915 | Sprong | A47D 13/025 224/160 |
| 4,436,233 | A | 3/1984 | Hill et al. | |
| 4,487,346 | A | 12/1984 | Fischer, Jr. | |
| 5,673,828 | A * | 10/1997 | Raedel | A47D 13/025 224/160 |
| 9,259,100 | B2 * | 2/2016 | Ng | A47D 15/006 |

FOREIGN PATENT DOCUMENTS

| | | |
|---|---|---|
| JP | 57037334 | 2/1982 |
| JP | 2006231033 | 9/2006 |
| JP | 3127392 | 11/2006 |
| JP | 2015192705 | 11/2015 |
| KR | 1020070033251 | 3/2007 |
| KR | 200473628 | 7/2014 |

(Continued)

OTHER PUBLICATIONS

Office Action issued in corresponding KR Application 10-2023-0124165, issued Mar. 5, 2024, and an English Translation, 9 pages.

(Continued)

*Primary Examiner* — Adam J Waggenspack
(74) *Attorney, Agent, or Firm* — Burris Law, PLLC

(57) ABSTRACT

A side hip seat baby carrier includes a shoulder portion worn across one shoulder of a wearer and a base portion worn to be located at a part of the wearer's waist that is at the opposite side of the one shoulder of the wearer. The side hip seat baby carrier further includes a connecting portion including a front connecting member to connect the base portion and an end portion of a front portion of the shoulder portion and a rear connecting member to connect the base portion and a rear portion of the shoulder portion.

4 Claims, 8 Drawing Sheets

(56) References Cited

FOREIGN PATENT DOCUMENTS

| | | |
|---|---|---|
| KR | 2020220003052 | 12/2022 |
| KR | 1020230065544 | 5/2023 |
| KR | 102690072 | 7/2024 |

OTHER PUBLICATIONS

Notice of Allowance issued in corresponding KR Application 10-2023-0124165, issued Jul. 1, 2024, and an English Translation, 4 pages.

* cited by examiner

SIDE HIP SEAT BABY CARRIER

CROSS-REFERENCE TO RELATED APPLICATIONS

This application is a continuation of International Application No. PCT/KR2023/014985, filed on Sep. 27, 2023, which claims priority to and the benefit of Korean Patent Application No. 10-2023-0124165, filed on Sep. 18, 2023. The disclosures of the above applications are incorporated herein by reference.

FIELD

The present disclosure relates to a side hip seat baby carrier, and more particularly, to a side hip seat baby carrier that allows angles at which a hip support and a back support are used to be freely changed.

BACKGROUND

The statements in this section merely provide background information related to the present disclosure and may not constitute prior art.

Babies usually start walking independently between 9 months and 15 months after being born. Babies who cannot walk yet are carried by being held by their caregivers, and in Asian cultures, a band-type baby carrier, in other words, a baby carrier, is used as an assistive tool for carrying babies for a long time.

Such a baby carrier should be designed in consideration of convenience as well as safety, and generally, a baby carrier has a structure that allows a caregiver to hold a baby on the front while supporting the baby's back and buttocks with a connecting strap attached to the caregiver's shoulders and waist.

When such a baby carrier is used, there is an advantage that a baby's weight is distributed to a user's shoulders, waist, pelvis, or the like and the user is able to relatively freely use both arms. However, in the case of the conventional baby carrier that allows a user to hold a baby on the front, although there is an advantage that the baby's back can be stably supported, the baby may interfere with a user's front field of view or restrict movement of the front part of the user's body. Also, in the case of the conventional side baby carrier that allows a user to hold a baby on a side of the user, since the baby carrier only consists of a hip seat that supports only the buttocks of the baby, there is an inconvenience that stability is low because support is insufficient to also support the baby's back or freedom of movement is low because the user needs to support the baby with both hands at all times. Further, since the baby carrier is unable to wrap around a wide part of the user's shoulders, a load is not distributed to a wide area of the shoulders, and significant strain is put on the user's shoulders.

SUMMARY

This section provides a general summary of the disclosure and is not a comprehensive disclosure of its full scope or all of its features.

Various examples of the present disclosure are for addressing the above-described issues and are directed to providing a side hip seat baby carrier.

For example, the present disclosure is directed to providing a side hip seat baby carrier that allows a wearer to conveniently hold a baby on one side of the wearer's body and freely use the arm on the other side of the body.

The present disclosure is also directed to providing a side hip seat baby carrier that allows a wearer to stably and safely support a baby in various postures while holding the baby on one side.

The present disclosure is also directed to providing a side hip seat baby carrier that is convenient due to being easy to carry due to its compact size.

Technical Solution

A side hip seat baby carrier according to various examples of the present disclosure is disclosed.

As a side hip seat baby carrier according to one example, there may be provided a sling-type baby carrier including a shoulder portion worn across one shoulder of a wearer; a base portion worn to be located at a part of the wearer's waist that is at the opposite side of the one shoulder of the wearer; and a connecting portion including a front connecting member configured to connect the base portion and an end portion of a front portion of the shoulder portion and a rear connecting member configured to connect the base portion and a rear portion of the shoulder portion, wherein the base portion, the shoulder portion, and the connecting portion have a circular carrier structure and are worn to wrap around the wearer's upper body in a diagonal direction, the base portion includes a hip support and a back support of the same shape. In an overlapping state, connecting portions at both ends of the hip support and the back support are each fixed to a strap of the front connecting member or a strap of the rear connecting member, whereby, with both ends of the hip support and the back support being fixed, the positional relationship between the hip support and the back support can be adjusted according to their degree of overlap while carrying a baby on the hip support, thereby allowing for changes in usage positions, and the hip support and the back support can be positioned such that a central portion of the hip support and a central portion of the back support do not overlap each other.

According to one example, in the sling-type baby carrier, the connecting portion of the hip support may overlap a connecting strap of the back support and a strap connecting portion of the strap, the connecting portion of the hip support and the strap connecting portion of the strap may be fixed through a first backstitch at an inner portion close to a central portion of the hip support, and the connecting portion of the hip support, the strap connecting portion of the strap, and the connecting strap of the back support may be adjacent to the inner portion and may be fixed through a second backstitch at an outer portion close to the both end portions.

According to one example, in the sling-type baby carrier, the base portion may further include a connecting strap, and both end portions of the connecting strap may each be fixed to one of a boundary portion between the central portion and the both end portions of the hip support and a boundary portion between a central portion and the both end portions of the back support, between an outer surface of the hip support and an inner surface of the back support.

According to one example, in the sling-type baby carrier, the first backstitch and the second backstitch may be a box-X stitch, and at the second backstitch, a reinforcing backstitch may be further sewn at stitches at both ends of the connecting portion.

According to one example, in the sling-type baby carrier, the front connecting member may further include a buckle and a front strap, a female part and a male part of the buckle may each be length-adjustably connected to one of the front portion of the shoulder portion and the front strap, an elastic string may be provided at one of the female part and the male part of the buckle, and a strap fixing band may be provided at an end portion of the front strap.

Other details of the present disclosure are included in the detailed description and drawings.

In a side hip seat baby carrier according to various examples of the present disclosure, since a hip support and a back support are separately provided at a base portion, and the hip support and the back support are provided to overlap each other while both end portions thereof are fixed. As a result, the side hip seat baby carrier can be used by varying the positional relationship between the hip support and the back support. Due to the positional relationship between the seat support 11 and the back support 12, the side hip seat baby carrier allows for flexible adjustment of the overlap between the seat support 11 and back support 12. In particular, this side hip seat baby carrier makes it easy to unfold the seat support 11 and back support 12, even when weight is applied. Thus, a wearer can stably and safely support a baby in various postures while holding the baby on one side.

In addition, a side hip seat baby carrier according to various examples of the present disclosure can provide convenience because it is easy to carry due to its compact size.

Advantageous effects of the present disclosure are not limited to the above-mentioned advantageous effects, and other unmentioned advantageous effects may be clearly understood by those of ordinary skill in the art based on the description below.

Further areas of applicability will become apparent from the description provided herein. It should be understood that the description and specific examples are intended for purposes of illustration only and are not intended to limit the scope of the present disclosure.

DRAWINGS

Various aspects are described with reference to the drawings, throughout which reference numerals are used to refer to like components. In the following examples, for the purpose of explanation, multiple specific details are set forth to provide overall understanding of one or more aspects. However, it should be apparent that such aspect(s) may be carried out without such specific details.

In order that the disclosure may be well understood, there will now be described various forms thereof, given by way of example, reference being made to the accompanying drawings, in which.

Figure 1:
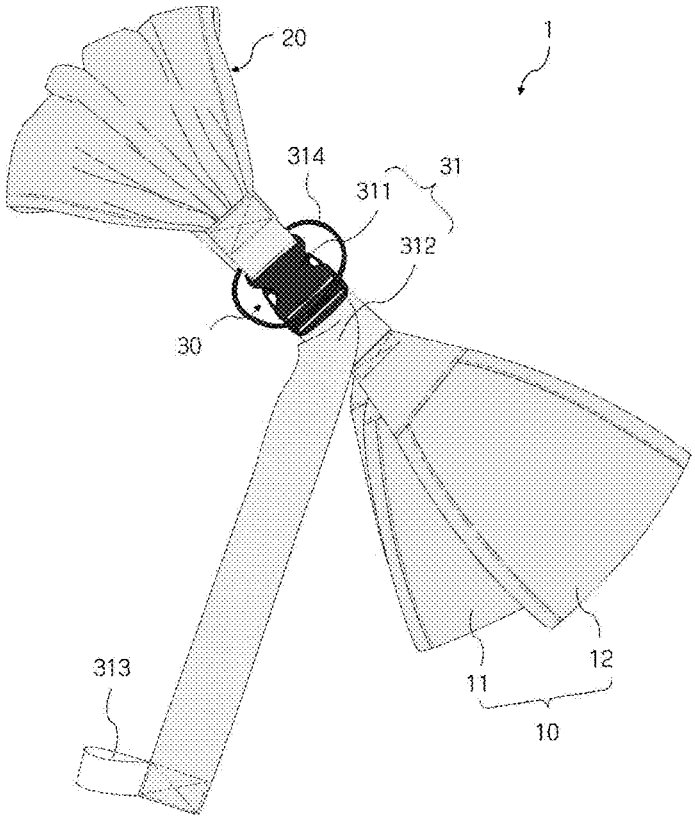
FIG. 1 illustrates a front view portion of a sling-type baby carrier according to various examples of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Various examples and/or aspects will be described below with reference to the drawings. In the following description, numerous specific details are set forth in order to provide a thorough understanding of one or more aspects for the purpose of explanation. However, it will also be appreciated by a person having ordinary skill in the art that such aspect(s) may be carried out without the specific details. The following description and accompanying drawings will be set forth in detail for specific illustrative aspects among one or more aspects. However, the aspects are merely illustrative, some of various ways among principles of the various aspects may be employed, and the descriptions set forth herein are intended to include all the various aspects and equivalents thereof. Specifically, the term "example," "aspect," "exemplification," or the like as used herein may not be construed to mean that an aspect or design set forth herein is preferable or advantageous to other aspects or designs.

Hereinafter, the same or similar components will be denoted by the same reference numerals throughout the drawings, and overlapping description thereof will be omitted. Also, in describing examples disclosed herein, when detailed description of a known related art is determined as having the possibility of obscuring the gist of the examples disclosed herein, the detailed description thereof will be omitted. Also, the accompanying drawings are only for facilitating the understanding of the examples disclosed herein, and the technical spirit disclosed herein is not limited by the accompanying drawings.

Although terms such as "first" and "second" are used to describe various elements or components, of course, these elements or components are not limited by these terms. These terms are only used to distinguish one element or component from another element or component. Therefore, of course, a first element or component mentioned below may also be a second element or component within the technical spirit of the present disclosure.

Unless defined otherwise, all terms including technical and scientific terms used herein may be used with meanings that may be commonly understood by those of ordinary skill in the art to which the present disclosure pertains. Also, terms defined in commonly used dictionaries should not be interpreted in an idealized or overly formal sense unless expressly so defined herein.

In addition, the term "or" is intended to mean inclusive "or" instead of exclusive "or." That is, unless specified otherwise or the context clearly indicates otherwise, "X uses A or B" is intended to mean one of natural inclusive substitutions. That is, "X uses A or B" may apply to any of the cases in which X uses A, X uses B, or X uses both A and B. Also, the term "and/or" used herein should be understood as referring to and including all possible combinations of one or more of the listed related items.

Also, the terms "include" and/or "including" should be understood as indicating the presence of corresponding features and/or components but not excluding the presence or addition of one or more other features, components, and/or groups thereof. Also, unless specified otherwise or the context clearly indicates singularity, a singular expression should be generally interpreted as indicating "one or more" in the present specification and the claims.

When a certain component is mentioned as being "connected" or "linked" to another component, it should be understood that the component may be directly connected or linked to the other component, but another component may be present therebetween. On the other hand, when a certain component is mentioned as being "directly connected" or "directly linked" to another component, it should be understood that no other component is present therebetween.

When a component or layer is referred to as being "on" or "above" another component or layer, this not only includes a case in which the component or layer is right above the other component or layer but also includes a case in which another layer or component is interposed therebetween. On the other hand, when a component is referred to as being "directly on" or "right above" another component, this indicates that no other component or layer is interposed therebetween.

Spatially relative terms such as "inner," "outer," "beneath," "below," "lower," "above," and "upper" may be used herein to readily describe the relationship between one component or feature and other component(s) or feature(s) illustrated in the drawings. The spatially relative terms may be intended to encompass different orientations of the device in use or operation in addition to the orientations illustrated in the drawings. For example, if the device in the drawings is flipped upside down, components described as "below" or "beneath" other components or features would then be oriented "above" the other components or features. Thus, the exemplary term "below" can encompass both orientations of above and below. The device may be otherwise oriented (rotated 90° or at other orientations) and the spatially relative descriptors used herein may be interpreted accordingly.

When a component or layer is mentioned as being "on," "engaged to," "connected to," or "coupled to" another component or layer, the component or layer may be directly on, engaged to, connected to, or coupled to the other component or layer, or other components or layers may be interposed therebetween. In contrast, when a component or layer is mentioned as being "directly on," "directly engaged to," "directly connected to," or "directly coupled to" another component or layer, no other components or layers are interposed therebetween. Other words used to describe the relationships between components should be interpreted in a like fashion (e.g., "between" versus "directly between," "adjacent" versus "directly adjacent," etc.). As used herein, the term "and/or" includes any and all combinations of one or more of associated listed items.

Objects and effects of the present disclosure and technical configurations for achieving the same will become apparent with reference to examples described in detail below and the accompanying drawings. In describing the present disclosure, when detailed description of known functions or configurations is determined as having the possibility of unnecessarily obscuring the gist of the present disclosure, the detailed description thereof will be omitted. Also, the terms described below are terms defined in consideration of their functionality in the present disclosure and may vary depending on an intention of a user or an operator, customary practice, or the like.

However, the present disclosure is not limited by examples disclosed below and may be implemented in various different forms. The present examples are provided to make the disclosure of the present disclosure complete and to fully inform those of ordinary skill in the art to which the present disclosure pertains of the scope of the disclosure, and the present disclosure is only defined by the scope of the claims. Therefore, the definition should be made based on the entire content of the present specification.

Figure 2:
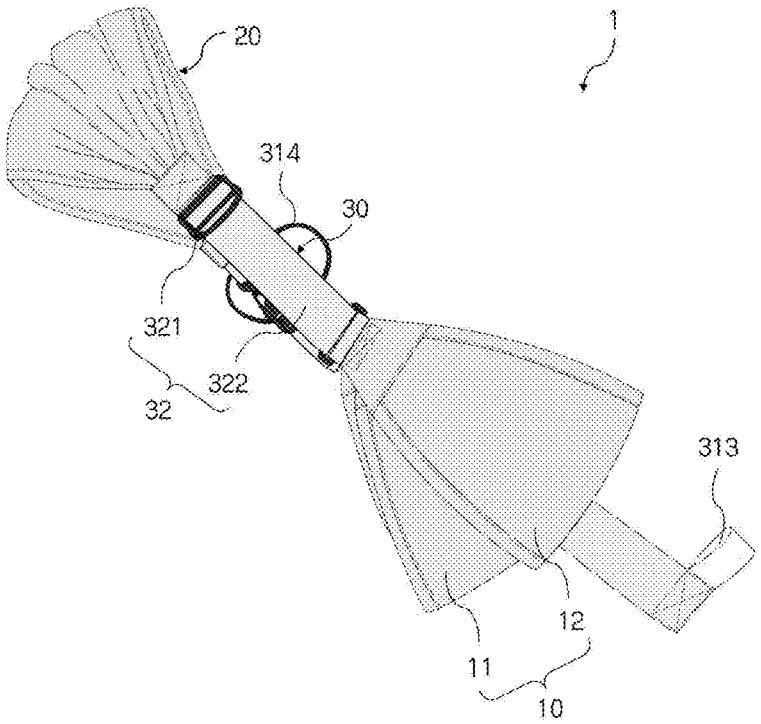
FIG. 2 illustrates a rear view portion of the sling-type baby carrier according to various examples of the present disclosure.
Figure 3:
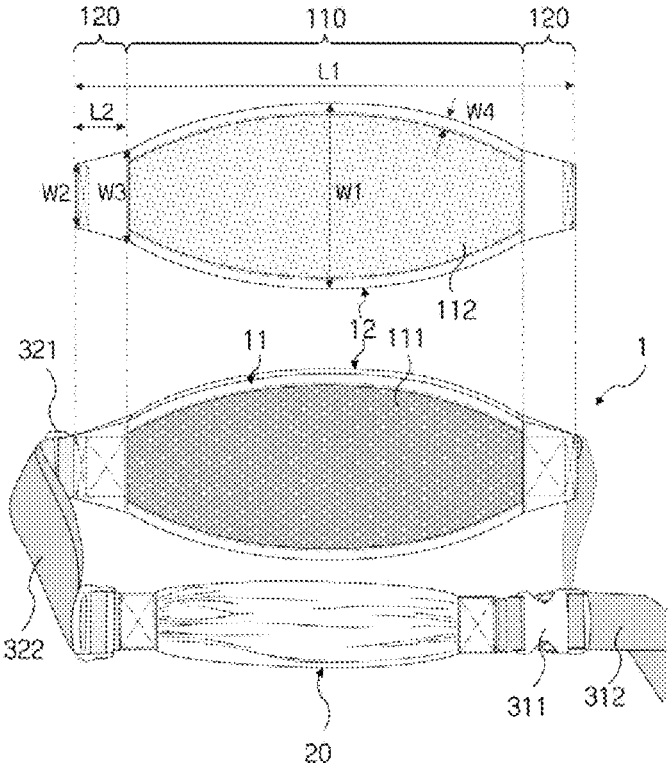
FIG. 3 illustrates an unfolded state of the sling-type baby carrier according to various examples of the present disclosure.
Figure 4:
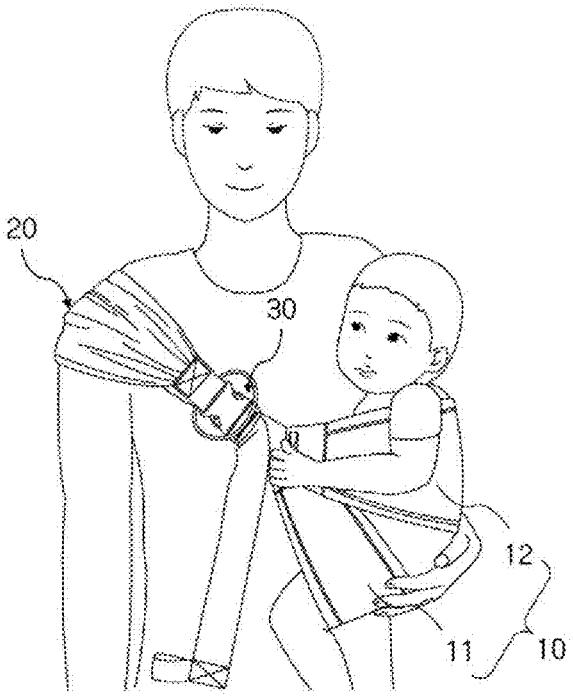
FIG. 4 illustrates a state in which the sling-type baby carrier according to various examples of the present disclosure is worn on a wearer.

FIG. 1 illustrates a front portion of a sling-type baby carrier 1 according to various examples of the present disclosure. FIG. 2 illustrates a rear portion of the sling-type baby carrier 1 according to various examples of the present disclosure. FIG. 3 illustrates an unfolded state of the sling-type baby carrier 1 according to various examples of the present disclosure. FIG. 4 illustrates a state in which the sling-type baby carrier 1 according to various examples of the present disclosure is worn on a wearer. FIG. 5 illustrates various examples of using a hip support 11 and a back support 12 of a base portion 10 according to various forms of the present disclosure.

Referring to FIGS. 1 to 3, the sling-type baby carrier 1 may include a base portion 10, a shoulder portion 20, and a connecting portion 30.

The base portion 10 may include the hip support 11 that can support a baby's buttocks part and the back support 12 that can support the baby's back part. The hip support 11 may provide a seating surface on which the baby's buttocks are seated. The back support 12 may support the baby's back to further provide stable support for the baby seated on the hip support 11.

The hip support 11 and the back support 12 may have a shape that defines a relatively wide and recessed space to allow a baby to be seated. For example, the hip support 11 and the back support 12 may have a form whose width is relatively wide at a central portion and gradually narrows toward both end portions. The hip support 1 and the back support 12 may have the widest width in the central part.

The shoulder portion 20 may be a member worn on one shoulder of a wearer. The shoulder portion 20 may have the form of a relatively wide fabric or strap. For example, the shoulder portion 20 may be made of knitted fabric (or Daimaru fabric). The shoulder portion 20 may be made of stretch fabric that is stretchable in both directions. The stretch fabric is usually manufactured together with synthetic fibers such as polyester, nylon, spandex, and lycra and may have high elasticity and restorability. The shoulder portion 20 may have a form whose width is relatively wide at a central portion and gradually narrows toward both end portions. Since the shoulder portion 20 may be used to entirely cover the wearer's one shoulder, the shoulder portion 20 may serve to reduce pressure applied to the wearer's shoulder.

That is, for the shoulder portion 20 according to various examples of the present disclosure, fabric that widely and evenly wraps around the shoulder may be used to distribute the baby's weight to a wide area and reduce fatigue of the wearer's shoulder. Also, since the shoulder portion 20 can be folded in a compact size as compared to a common strap (or string), portability of the sling-type baby carrier 1 itself may also be improved.

For example, the central portion of the shoulder portion 20 may have a width of about 27 cm when completely unfolded. Both end portions of the shoulder portion 20 may have a width of about 5 cm.

The connecting portion 30 may connect the base portion 10 and the shoulder portion 20. The connecting portion 30 may connect one end portion of the base portion 10 and one end portion of the shoulder portion 20 to each other and may include a front connecting member 31 whose length is adjustable and a rear connecting member 32 whose length is adjustable and which can connect the other end portion of the base portion 10 and the other end portion of the shoulder portion 20 to each other.

The front connecting member 31 may include a buckle 311 connected to the one end portion of the shoulder portion 20 and a front strap 312 connected between the buckle 311 and the one end portion of the base portion 10.

The rear connecting member 32 may include an adjuster 321 connected to the other end portion of the shoulder portion 20 and a rear strap 322 connected between the adjuster 321 and the other end portion of the base portion 10.

The buckle 311 may include a separation type buckle structure. For example, the buckle 311 may include a one-touch separation type buckle structure. The buckle 311 may include a female part and a male part. The female part may be connected to the shoulder portion 20, and the male part may be connected to the front strap 312. According to various examples, the female part may be connected to the front strap 312, and the male part may be connected to the shoulder portion 20. The female part and the male part of the buckle 311 may have a locking mechanism including a snap button or the like that allows the female part and the male part to be fixed to each other by the male part being inserted into the female part. However, a specific configuration of the buckle 311 is not limited to that described above and may vary.

For example, in one example, an elastic string 314 may be provided at the female part or male part of the buckle 311. The elastic string 314 may be fixed to a female part or a male part and may be used to be caught on another female part or male part. For example, the elastic string 314 may be fixed to the female part of the buckle 311 connected to a front portion of the shoulder portion 20. The elastic string 314 may be configured to be caught on the male part of the buckle 311 connected to the front strap 312. The elastic string 314 may serve to, even when the buckle 311 is separated, allow the buckle 311 to be connected by the elastic string 314 without being completely separated. That is, even when the wearer separates the buckle 311, the base portion 10 of the sling-type baby carrier 1 may be supported by the elastic string 314 without falling down completely. That is, even when the base portion 10 falls completely to the floor, or the buckle 311 is separated in a state in which a baby is seated on the base portion 10, the elastic string 314 may primarily support the base portion 10 to improve stability.

The front strap 312 may be configured to allow a length between the base portion 10 and the buckle 311 to be adjusted. The wearer may pull the front strap 312 or release the front strap 312 in the opposite direction to adjust the length between the front strap 312 and the buckle 311.

Likewise, the rear strap 322 may be configured to use the adjuster 321 and allow a length between the base portion 10 and the adjuster 321 to be adjusted. The wearer may adjust the lengths of the front strap 312 and the rear strap 322 to adjust the connecting portion 30 to a length suitable for the body size and weight of the wearer and the baby.

In various examples, the buckle 311 may be substituted with another member such as a hook-and-loop fastener, a quick release pin, a toggle clamp, or a swivel hook.

The front strap 312 and the rear strap 322 may include a woven strap made of nylon. The front strap 312 and the rear strap 322 according to an example may include a woven strap made of polyester, cotton, canvas, leather, polypropylene, or Kevlar.

In one example, the front strap 312 may further have a strap fixing band 313 provided at an end portion. The strap fixing band 313 may have the form of a loop band. Specifically, the strap fixing band 313 may have the form of a loop band attached to a side surface at the end portion of the front strap 312. A portion of the front strap 312 that remains after adjusting the length of the front strap 312 may be accommodated in the loop band for organization.

Referring to FIG. 3, the hip support 11 and the back support 12 may have substantially the same form. The hip support 11 and the back support 12 may have the same shape and size and may completely overlap each other.

Both end portions of the hip support 11 and the back support 12 may be connected to each other in a state in which the hip support 11 and the back support 12 overlap each other. The hip support 11 and the back support 12 may connect at both ends when in an overlapping state. The term "ends of the support section 10" may refer to the portions where each end of the hip support 11 and back support 12 overlap in this state.

In this configuration, the connection structure at both ends of the hip support 11 and the back support 12 is designed to allow the hip support 11 and back support 12 to at least partially overlap. Specifically, the ends of the support section 10 connect the ends of the hip support 11 and back support 12, enabling a change in the positional relationship between the hip support 11 and the back support 12. This positional relationship can be expressed as the angle between the hip support 11 and the back support 12.

As described above, both end portions of the base portion 10 may be connected to the front connecting member 31 and the rear connecting member 32 included in the connecting portion 30, and in one example, both end portions of both the hip support 11 and the back support 12 may be connected to the front connecting member 31 and the rear connecting member 32. A specific structure in which the hip support 11 and the back support 12 are connected to the connecting portion 30 will be described below.

In one example, in the hip support 11 and the back support 12, a central portion 110 may have the longest width w1 of about 18 cm, and both end portions 120 may each have a width w2 of about 5 cm. Connecting portions between the central portion 110 and the both end portions 120 may each have a width w3 of about 6 cm.

The hip support 11 and the back support 12 may each have a total length L1 of about 59 cm, the both end portions 120 may each have a length L2 of about 9.5 cm, and the central portion 110 may have a length of about 40 cm.

In the hip support 11 and the back support 12, an edge portion of the central portion 110 may be finished. For example, the central portion 110 of each of the hip support 11 and the back support 12 may be hemmed or bound, and here, the edge portion may have a width w4 of about 1.5 cm.

In one example, an anti-slip pad 111 may be attached as a lining of the central portion 110 of the hip support 11. The anti-slip pad 111 may inhibit the baby seated on the hip support 11 from sliding and falling when the sling-type baby carrier 1 is worn on the wearer. For example, the anti-slip pad 111 may include one of silicone rubber, rubber, polyurethane, polyvinyl chloride (PVC), and melamine sponge.

In one example, a mesh pad 112 may be attached as a lining of the central portion 110 of the back support 12. The mesh pad 112 may allow sweat from the baby's back to be easily discharged when the sling-type baby carrier 1 is worn on the wearer. For example, the mesh pad 112 may be made of one of polyester, nylon, polypropylene, and acryl.

Additional members such as the anti-slip pad 111 and the mesh pad 112 may provide more comfort and stability to both the wearer and the baby.

As illustrated in FIGS. 1 to 3, the base portion 10, the shoulder portion 20, and the connecting portion 30 may be connected so that the sling-type baby carrier 1 has a circular carrier structure. Referring to FIG. 4, the sling-type baby carrier 1 having such a structure may be used to wrap around the wearer's upper body in a diagonal direction. The sling-type baby carrier 1 may be worn so that the shoulder portion 20 is located to cover one shoulder of the wearer, and the base portion 10 is located at the opposite side of the one shoulder of the wearer. The front connecting member 31 may be located on the front of the wearer, and the sling-type baby carrier 1 may be put on or taken off through the buckle 311. The rear connecting member 32 may be located on the rear (or back) of the wearer.

A seating space provided by the base portion 10 may allow a baby to be held by the wearer. The hip support 11 may support the baby's buttocks part, and the back support 12 may support the baby's back part. The back support 12 may support the baby so that the baby does not move away from the hip support 11 even when the baby moves or the wearer leans his or her body.

The base portion 10 according to various examples of the present disclosure may stably support the baby's back and body due to having the back support 12 provided separately from the hip support 11.

In various examples of the present disclosure, since the hip support 11 and the back support 12 of the base portion 10 have the same form and are connected to each other only through the both end portions 120 thereof, the hip support 11 and the back support 12 may be used by varying their positions relative to each other according to changes in the baby's body shape caused by growth or according to different purposes of use.

Referring to FIG. 5, the side hip seat baby carrier 1 can accommodate various usage states due to changes in the positional relationship between the hip support 11 and the back support 12.

Figure 5A:
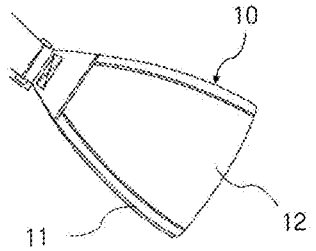
FIG. 5A illustrates a usage state in which the seat support and back support completely overlap.

For example, referring to FIG. 5A, the hip support 11 and the back support 12 of the base portion 10 may be used in a state in which they completely overlap each other to simply support only the baby's buttocks. Also, as in FIG. 5B and FIG. 5C, the hip support 11 and the back support 12 may be used in a state in which the back support 12 is lifted relative to the hip support 11 to stably support the baby. As can be seen from FIG. 5B and FIG. 5C, since the back support 12 can be used at various positions and angles relative to the hip support 11, the position can be changed to adapt to the baby's size and posture.

Figure 5B:
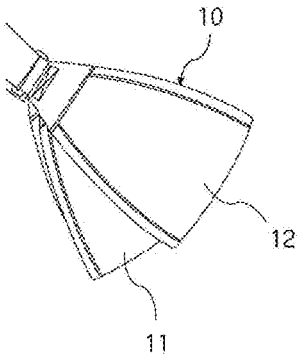
FIG. 5B illustrates a usage state where a portion of the seat support partially overlaps with a portion of the back support.
Figure 5C:
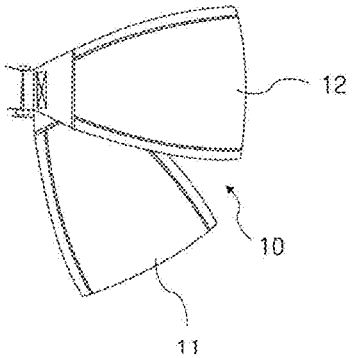
FIG. 5C illustrates a usage state in which the central part of the seat support does not completely overlap with the central part of the back support.

The side hip seat baby carrier 1 is designed to freely adjust the degree of overlap between the hip support 11 and back support 12, even when a baby is seated on the hip support 11 and the baby's weight is applied to it, as shown in FIG. 5A to FIG. 5C. This side hip seat baby carrier 1 allows easy adjustment of the back support 12, enabling the positional relationship between the hip support 11 and back support 12 to be modified effortlessly, even under the baby's weight. As a result, even with the baby's weight on the hip support 11, the central parts of the hip support 11 and back support 12 can be fully separated and unfolded, as shown in FIG. 5C.

This side hip seat baby carrier 1 overcomes the structural limitations of conventional baby carriers, where it is difficult to unfold the hip support 11 and back support 12 when they are partially overlapped and bearing the baby's weight.

Figure 6A:
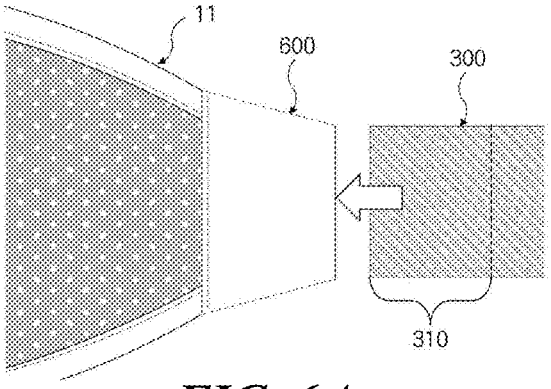
FIG. 6A illustrates a connection structure of both end portions of the hip support and a strap for forming a connection structure of the hip support and the back support according to various examples of the present disclosure.
Figure 6B:
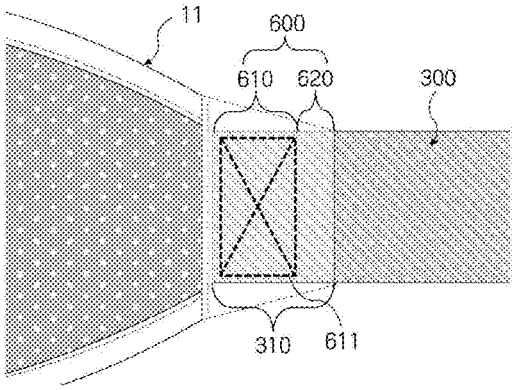
FIG. 6B illustrates the connection structure of both end portions of the hip support and a strap for forming a connection structure of the hip support and the back support according to various examples of the present disclosure.
Figure 7A:
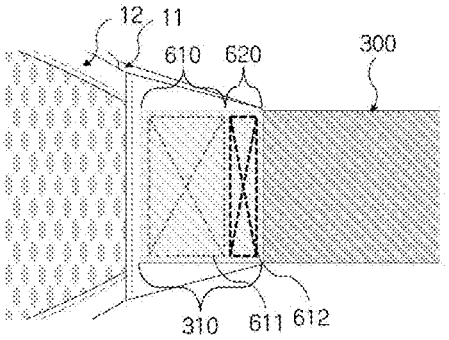
FIG. 7A illustrates a connection structure of the hip support and the back support according to various examples of the present disclosure.
Figure 7B:
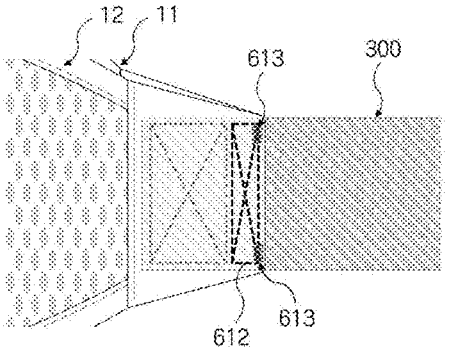
FIG. 7B illustrates a connection structure of the hip support and the back support according to various examples of the present disclosure.

FIGS. 6A to 7B illustrate connection structures of the hip support 11 and the back support 12 according to various examples of the present disclosure. FIG. 6A and FIG. 6B illustrate a connection structure of both end portions of the hip support and a strap for forming a connection structure of the hip support and the back support according to various examples of the present disclosure. FIG. 7A and FIG. 7B illustrate a connection structure of the hip support and the back support according to various examples of the present disclosure. FIG. 6A to FIG. 7B sequentially illustrate a process of connecting the hip support 11 and the back support 12.

First, referring to FIG. 6A and FIG. 6B, a strap 300 may be connected to connecting portions 600 of the both end portions 120 of the hip support 11. For example, the strap 300 may be a member for connecting the buckle 311 to the shoulder portion 20 at the front connecting member 31 described above or may be the front strap 312 connected to the base portion 10. Also, the strap 300 may be a member for connecting the adjuster 321 to the shoulder portion 20 at the rear connecting member 32 or may be the rear strap 322 connected to the base portion 10. A structure for connecting a strap for connecting various straps or members connected to the hip support 11 and the back support 12 of the base portion 10 will be described below.

The connecting portions 600 of the hip support 11 and a portion of the strap 300 may overlap. The connecting portions 600 may be the same configuration as the both end portions 120 of the hip support 11.

The portion of the strap 300 that overlaps the connecting portion 600 may be referred to as a strap connecting portion 310. The portion of the connecting portion 600 of the hip support 11 that overlaps the strap connecting portion 310 may be divided into an inner portion 610 and an outer portion 620.

After the connecting portion 600 of the hip support 11 and the strap connecting portion 310 of the strap 300 are overlapped, at the inner portion 610, the connecting portion 600 and the strap connecting portion 310 may be fixed by a first backstitch 611.

Referring to FIG. 7A, the back support 12 may be overlapped on the hip support 11 primarily fixed to the strap 300 by the first backstitch 611. The connecting portion 600 of the back support 12 may completely overlap the connecting portion 600 of the hip support 11. The overlapping connecting portions 600 of the hip support 11 and the back support 12 may also be divided into the inner portion 610, where the first backstitch 611 is sewn, and the outer portion 620.

The hip support 11 and the back support 12 that overlap may be fixed to each other by a second backstitch 612 at the outer portion 620 of the connecting portion 600. That is, the second backstitch 612 may not only fix the hip support 11 and the back support 12 but also further fix the strap 300.

In the base portion 10 completed through the above process, the connecting portion 600 of the hip support 11 may be fixed due to overlapping of the connecting portion 600 of the back support 12 and the strap connecting portion 310 of the strap 300, and as a result, a connection structure of the hip support 11 and the back support 12 is formed and stably maintained.

In various examples of the present disclosure, the connecting portion 600 of the hip support 11 and the strap connecting portion 310 of the strap 300 may be fixed through the first backstitch 611 at the inner portion 610 close to the central portion 110 of the hip support 11. The connecting portion 600 of the hip support 11, the strap connecting portion 310 of the strap 300, and the connecting portion 600 of the back support 12 may be adjacent to the inner portion 610 and may be fixed through the second backstitch 612 at the outer portion 620 close to the both end portions 120.

Through the above fixing structure, the hip support 11 and the back support 12 may be firmly fixed to the strap 300 of the connecting portion 30, and thus the hip support 11 and the back support 12 may be used at various angles according to the purpose of use and the posture and body shape of the baby.

In one example, referring to FIG. 7B, a reinforcing backstitch 613 for reinforcing the second backstitch 612 may be further sewn at stitches at both ends of the connecting portion 600 at the second backstitch 612. This is because both end portions of the second backstitch 612 are portions where a force that tends to cause separation between the connecting portion 600 of the base portion 10 and the strap 300 of the connecting portion 30 is the greatest during use of the sling-type baby carrier 1. As the reinforcing backstitch 613, an overlock backstitch may be implemented to cover a stitch of the second backstitch 612 (or also a stitch of the first backstitch 611).

In the illustrated example, the first backstitch 611 and the second backstitch 612 may be a box-X stitch in which a backstitch is sewn in an X-shape diagonally inside a backstitch sewn in a quadrangular shape, and in various examples, alternatively or additionally, a double stitch or a chain stitch may be further sewn, a rivet or button may be further attached, or an adhesive may be further applied. Also, in one example, a portion where the connecting portion 600, a connecting strap 900, and the strap connecting portion 310 overlap may be sewn with a backstitch and fixed in a state in which an additional reinforcing fabric is placed to overlap the portion.

Figure 8A:
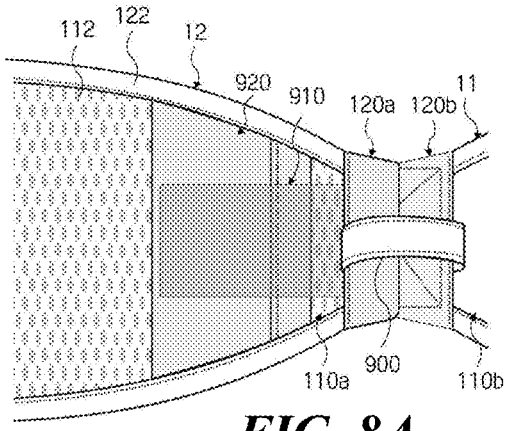
FIG. 8A illustrates a connection structure of the hip support and the back support according to additional examples of the present disclosure.
Figure 8B:
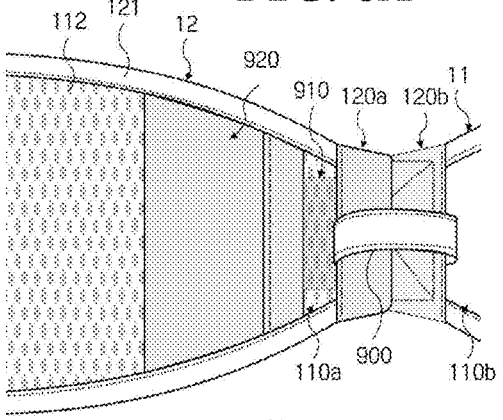
FIG. 8B illustrates a connection structure of the hip support and the back support according to additional examples of the present disclosure.

FIG. 8A and FIG. 8B illustrate a connection structure of the hip support 11 and the back support 12 according to additional examples of the present disclosure.

Referring to FIG. 8A, the connecting strap 900 may be further attached to the hip support 11 and the back support 12 according to one example. The connecting strap 900 may connect an outer surface of the hip support 11 and an inner surface of the back support 12. Both ends of the connecting strap 900 may be connected to boundary portions between central portions 110*a* and 110*b* and both end portions 120*a* and 120*b* in each of the hip support 11 and the back support 12. As described above, the both end portions 120*a* and 120*b* of the hip support 11 and the back support 12 may be fixed by the second backstitch 612 of the outer portion 620, and the connecting strap 900 may assist with fixing of the hip support 11 and the back support 12. For example, the connecting strap 900 may have a length of about 4.6 cm and a width of about 1.5 cm.

In one example, the connecting strap 900 may be made of a fabric with high elasticity and restorability or may have a material with high elasticity and restorability (e.g., a rubber band) embedded therein. For example, the connecting strap 900 may be made of spandex, lycra, or elastane. Even when the hip support 11 and the back support 12 are used while greatly deviated from the state in which the hip support 11 and the back support 12 overlap each other, due to the restorability of the connecting strap 900, the hip support 11 and the back support 12 may be restored to the state in which the hip support 11 and the back support 12 completely overlap each other. Accordingly, a convenient experience may be provided regarding organization of the hip support 11 and the back support 12, and high portability may be provided due to ease of storage and movement.

Referring to FIG. 8B, in one example, a label 910 and a label pocket 920 may be further provided at the back support 12. The label pocket 920 may be provided at the mesh pad 112 or an inner surface of the back support 12 and may be fixed at an edge 121 of the mesh pad 112. The label 910 may have one end portion fixed at boundary portions between the central portion 110 and the both end portions 120 of the back support 12. The label 910 may be configured to be inserted into the label pocket 920 or withdrawn from the label pocket 920. Since the label pocket 920 may be provided to be a predetermined distance (for example, ½ an inch) from the boundaries between the central portion 110 and the both end portions 120, the label 910 may be partially exposed at boundaries between the label pocket 920 and the both end portions 120. The user may grip the exposed label 910 and withdraw the label 910 from the label pocket 920 or insert the label 910 into the label pocket 920. The label 910 may be provided as a guideline for correctly managing and maintaining the sling-type baby carrier 1. For example, information such as whether washing, drying, ironing, wet cleaning, or dry cleaning is possible for the sling-type baby carrier 1 and correct usage of the sling-type baby carrier 1 may be included in the label 910.

A side hip seat baby carrier 1 according to various examples of the present disclosure may include: a shoulder portion 20 worn across one shoulder of a wearer; a base portion 10 worn to be located at a part of the wearer's waist that is at the opposite side of the one shoulder of the wearer; and a connecting portion 30 including a front connecting member 31 configured to connect the base portion 10 and an end portion of a front portion of the shoulder portion 20 and a rear connecting member 32 configured to connect the base portion 10 and a rear portion of the shoulder portion 20.

The base portion 10, the shoulder portion 20, and the connecting portion 30 have a circular carrier structure and are worn to wrap around the wearer's upper body in a diagonal direction.

The seat portion 10 includes a hip support 11 and a back support 12, which are in an overlapping state. The connecting portions 600 at both ends of the hip support 11 and the back support 12 are each fixed to a strap 300 of the front connecting member 31 and a strap 300 of the rear connecting member 32. As the hip support 11 and the back support 12 are fixed at both end portions, the user's posture can be adjusted based on the degree of overlap between the hip support 11 and the back support 12. With the hip support 11 and the back support 12 fixed at both ends, when an infant is seated on the hip support 11, the positional relationship between the hip support 11 and the back support 12 changes according to the overlap, allowing the user posture of the side hip seat baby carrier to be adjusted.

According to one example of the present disclosure, the connecting portion 600 of the hip support 11 may overlap a connecting strap 900 of the back support 12 and a strap connecting portion 310 of the strap 300, the connecting portion 600 of the hip support 11 and the strap connecting portion 310 of the strap 300 may be fixed through a first backstitch 611 at an inner portion 610 close to a central portion 110 of the hip support 11, and the connecting portion 600 of the hip support 11, the strap connecting portion 310 of the strap 300, and the connecting strap 900 of the back support 12 may be adjacent to the inner portion 610 and may be fixed through a second backstitch 612 at an outer portion 620 close to the both end portions 120.

According to one example of the present disclosure, the base portion 10 may further include a connecting strap 900, and both end portions of the connecting strap 900 may each be fixed to one of a boundary portion between the central portion 110 and the both end portions 120 of the hip support 11 and a boundary portion between a central portion 110 and the both end portions 120 of the back support 12, between an outer surface of the hip support 11 and an inner surface of the back support 12.

According to one example of the present disclosure, the first backstitch 611 and the second backstitch 612 may be a box-X stitch, and at the second backstitch 612, a reinforcing backstitch 613 may be further sewn at stitches at both ends of the connecting portion 600.

According to one example of the present disclosure, the front connecting member 31 may further include a buckle 311 and a front strap 312, a female part and a male part of the buckle 311 may each be length-adjustably connected to one of the front portion of the shoulder portion 20 and the front strap 312, an elastic string 314 may be provided at one of the female part and the male part of the buckle 311, and a strap fixing band 313 may be provided at an end portion of the front strap 312.

The examples have been described above to allow any one of ordinary skill in the art to use or carry out the present disclosure. Various modifications of the examples should be apparent to those of ordinary skill in the art, and general principles defined herein may also apply to other examples without departing from the scope of the present disclosure. Thus, the present disclosure is not limited to the examples set forth herein and should be construed in the widest possible sense consistent with principles and novel features set forth herein.

A side hip seat baby carrier according to various examples of the present disclosure that allows angles at which a hip support and a back support are used to be freely changed can be usefully utilized for infants who are not able to support their own bodies and thus has high industrial applicability in the field of baby products and the field of infant care.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A side hip seat baby carrier comprising:

a shoulder portion worn across one shoulder of a wearer;

a base portion worn to be located at a part of the wearer's waist that is at the opposite side of the one shoulder of the wearer; and a connecting portion including a front connecting member configured to connect the base portion and an end portion of a front portion of the shoulder portion and a rear connecting member configured to connect the base portion and a rear portion of the shoulder portion, wherein the base portion, the shoulder portion, and the connecting portion have a circular carrier structure and are worn to wrap around the wearer's upper body in a diagonal direction, the base portion includes a hip support and a back support of the same shape, connecting portions at both ends of the hip support and the back support in an overlapping state are each fixed to a strap of the front connecting member or a strap of the rear connecting member, the connecting portion at both ends of the hip support overlaps a strap connecting portion of the strap of the front connecting member and a strap connecting portion of the strap of the rear connecting member, the connecting portion at both ends of the hip support and the strap connecting portion of the strap of the front connecting member and the strap connecting portion of the strap of the rear connecting member are fixed through a first backstitch at an inner portion close to a central portion of the hip support, the connecting portion at both ends of the hip support, the strap connecting portion of the strap of the front connecting member, a strap connecting portion of the strap of the rear connecting member, and the connecting portion at both ends of the back support are adjacent to the inner portion and are fixed through a second backstitch at an outer portion close to the both end portions, and whereby, with both ends of the hip support and the back support being fixed, the positional relationship between the hip support and the back support is adjustable according to their degree of overlap while carrying a baby on the hip support, thereby allowing for changes in usage positions, and at least one of the hip support and the back support are positionable between an overlapped state and a fully non-overlapped state, wherein the central portions of the hip support and the back support are separated from each other in the fully non-overlapped state while the hip support and the back support remain connected at their ends via the connecting portions.

2. The side hip seat baby carrier of claim 1, wherein:

the base portion further includes a connecting strap; and both end portions of the connecting strap are each fixed to one of a boundary portion between the central portion and the both end portions of the hip support and a boundary portion between a central portion and the both end portions of the back support, between an outer surface of the hip support and an inner surface of the back support.

3. The side hip seat baby carrier of claim 2, wherein:

the first backstitch and the second backstitch are box-X stitches; and at the second backstitch, a reinforcing backstitch is further sewn at stitches at both ends of the connecting portion.

4. The side hip seat baby carrier of claim 1, wherein:

the front connecting member further includes a buckle and a front strap;

a female part and a male part of the buckle are each length-adjustably connected to one of the front portion of the shoulder portion and the front strap;

an elastic string is provided at one of the female part and the male part of the buckle; and a strap fixing band is provided at an end portion of the front strap.

* * * * *